US005216470A

United States Patent [19]

Asanuma et al.

[11] Patent Number: 5,216,470

[45] Date of Patent: Jun. 1, 1993

[54] METHOD OF DETERMINING THE DENSITY OF TONER

[75] Inventors: Masato Asanuma, Nara; Masatoshi Kaneshige, Ikoma; Hisashi Kunihiro, Tenri, all of Japan

[73] Assignee: Sharp Kabushiki Kaisha, Osaka, Japan

[21] Appl. No.: 664,057

[22] Filed: Mar. 4, 1991

[30] Foreign Application Priority Data

Mar. 6, 1990 [JP] Japan ..... 2-55750

[51] Int. Cl.[5] ..... G03G 15/08

[52] U.S. Cl. ..... 355/246; 355/204

[58] Field of Search ..... 355/204, 246, 259, 208; 118/653, 688, 689, 691

[56] References Cited

U.S. PATENT DOCUMENTS

| | | | |
|---|---|---|---|
| 4,168,901 | 9/1979 | Ito et al. . | |
| 4,758,861 | 7/1988 | Nakamaru et al. | 355/246 X |
| 4,860,063 | 8/1989 | Okamoto | 355/246 X |
| 4,901,115 | 2/1990 | Nakamura et al. | 118/689 X |
| 5,031,123 | 7/1991 | Narukawa | 355/246 X |

FOREIGN PATENT DOCUMENTS

| | | |
|---|---|---|
| 58-194066 | 11/1983 | Japan . |
| 63-75770 | 4/1988 | Japan . |
| 2-093568 | 4/1990 | Japan . |

*Primary Examiner*—Joan H. Pendegrass
*Assistant Examiner*—Shuk Y. Lee
*Attorney, Agent, or Firm*—David G. Conlin; George W. Neuner

[57] ABSTRACT

Disclosed is a method of determining the density of toner in the developer in an image forming apparatus by the use of a density sensor which is located beside a stirring member for stirring the developer. The density of toner is repeatedly measured at regular intervals for a predetermined period of time, which is the time required for the stirring member to make one complete revolution or a plurality of complete revolutions. The measured values of toner density are averaged, so that the mean value is taken as the density of toner in the developer. Since the values of toner density are averaged over the above-mentioned predetermined period of time, the unevenness in the toner density caused by the revolution of the stirring member is leveled off, thereby attaining accuracy in the determination of the toner density. Also because the density sensor is located beside the stirring member, the height of the developer tank can be kept small.

3 Claims, 3 Drawing Sheets

METHOD OF DETERMINING THE DENSITY OF TONER

BACKGROUND OF THE INVENTION

1. Field of the Invention

The present invention relates to a method of determining the density of toner in developer used in a developing unit of an image forming apparatus, and particularly relates to a method of determining the density of toner in the developer by the use of a density sensor located in the vicinity of a stirring member which is disposed in a developer tank so as to stir the developer contained therein.

2. Description of the Prior Art

An electrophotographic image forming apparatus generally uses developer composed of toner and carrier for the formation of images, the toner being made of a resin and a colorant, and the carrier being made of powdered iron or the like. In an image forming process, the toner in the developer contained in a developer tank is consumed in developing a latent image formed on a photoconductor. Thus., as the image forming process is repeated, the density of toner in the developer (the weight ratio of toner to the developer) contained in the developer tank decreases. When the developer with reduced toner density is further used for image forming processes, fogging may occur in the resultant images, or the surface of the photoconductor may be scratched by the carrier in the developer. Thus, toner should be fed into the developer tank as the density of toner in the developer is decreased.

An image forming apparatus such as described above is provided with a density sensor for measuring the toner density in the developer, so that toner is supplied from a toner hopper into the developer tank when the measured value is less than a predetermined reference value. A sensor which measures magnetic permeability is usually employed as the density sensor.

In a conventional method of determining the density of toner in developer, the density sensor is installed in a position facing a developing roller disposed in the developer tank, or in the vicinity of a stirring member in the form of a screw or a blade which is also disposed in the developer tank so as to stir the developer.

When the density sensor is installed in a position facing the developing roller, however, the position of the sensor is limited to that above or below the developing roller because the photoconductor and the stirring member are disposed at both sides of the developing roller in a horizontal direction. The disposition of the density sensor above or below the developing roller increases the height of the developer tank having the developing roller and the stirring member disposed therein. The developer tank is so located as to face the photoconductor. Since many other process units must be located facing the photoconductor, the increase in the height of the developer tank is not desirable.

On the other hand, when the density sensor is installed in the vicinity of the stirring member, the developing roller, the stirring member and the density sensor can be arranged in that order substantially in a horizontal plane, so that the height of the developer tank can be kept small. With this arrangement, however, the toner density cannot be accurately determined. Since the stirring member rotates to stir the developer in the developing tank to mix the toner and the carrier, the density of the toner in the developer in the area near the stirring member fluctuates with the rotation of the stirring member. Thus, the value to be obtained by the density sensor fluctuates as the stirring member makes a revolution. In the conventional method, the density of toner is determined by the value obtained at a certain point of time. Thus, the determined value of the toner density is inaccurate because of the above-mentioned density fluctuation with the rotation of the stirring member. Furthermore, when the flowability of the developer decreases due to external disturbance such as changes in environment, the fluctuation in the toner density is increased, which further lowers the accuracy in the determination of the toner density.

SUMMARY OF THE INVENTION

The method of determining the density of toner according to the present invention, which overcomes the above-discussed and numerous other disadvantages and deficiencies of the prior art, is a method of determining the density of toner in developer used in a developing unit which has a developer tank containing the developer and also has a stirring member and a developing roller both disposed in the developer tank, said method comprising the steps of:

repeatedly measuring the density of toner in the developer at regular intervals of time by the use of a density sensor for a predetermined period of time, the density sensor being located in the vicinity of the stirring member, and the predetermined period of time being the time required for the stirring member to make an integral number of complete revolutions; and averaging the values of toner density measured by the density sensor.

In a preferred embodiment, the measuring of the density of toner is performed by measuring magnetic permeability of the developer.

In a preferred embodiment, the density sensor is substantially aligned with the stirring member and the developing roller in that order in a horizontal plane.

Thus, the invention described herein makes possible the objective of providing a method of determining the density of toner with high accuracy while the height of the developer tank is kept small.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 4:
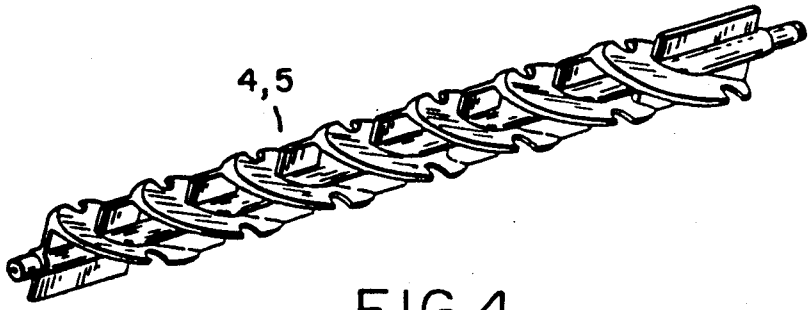
FIG. 4 is a perspective view showing a stirring member.
Figure 5:
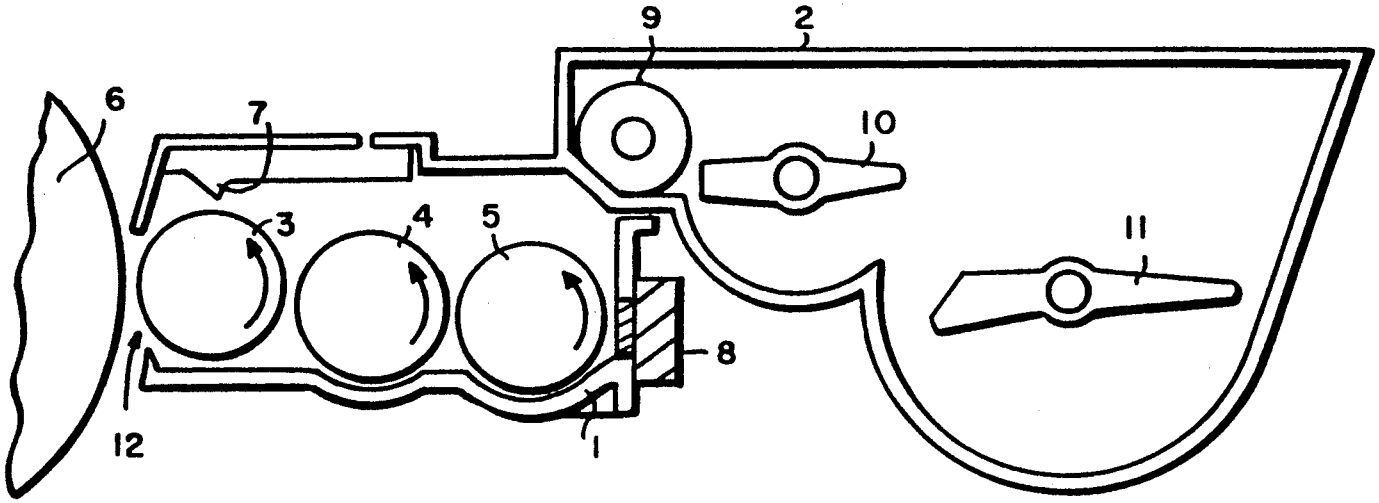
FIG. 5 is a sectional view showing a developing unit of an image forming apparatus, to which a method of determining toner density according to the invention is applied.

A method of determining the density of toner according to the present invention is used in an image forming apparatus which has a developing unit such as shown in FIG. 5. The developing unit includes a developer tank 1 and a toner hopper 2. The developer tank 1 contains developer composed of toner and carrier, and the toner hopper 2 contains toner, which is fed to the developer tank 1 when required. Disposed in the toner hopper 2 are stirring vanes 10 and 11 for preventing the toner contained therein from lumping Inside the developer tank 1, a developing roller 3 and stirring members 4 and 5 are substantially aligned in that order in a horizontal direction. The stirring members 4 and 5 are each in the form of a screw as specifically shown in FIG. 4, so that they stir the developer to mix the toner and the carrier. One side of the developer tank 1 is provided with an opening 12, through which the developing roller 3 faces a photoconductor 6. The developing roller 3 contains magnets therein and rotates to form on its surface a magnetic brush from the developer. The height of the magnetic brush is regulated by a doctor blade 7 also disposed in the developer tank 1.

The toner hopper 2 communicates with the developer tank 1 at their ends and at a position above the stirring member 5. At this communicating position is disposed a toner feed roller 9 which is made to rotate for a prescribed duration of time to supply toner from the toner hopper 2 to the developer tank 1.

The developing roller 3 and the stirring members 4 and 5 rotate in the directions indicated by the arrows shown in FIG. 5. The stirring member 5 stirs the developer to mix the toner and the carrier and to electrically charge the developer through friction. The electrically charged developer is then conveyed by the stirring member 4 onto the developing roller 3, on which a magnetic brush is then formed from the developer, i.e., from the toner and the carrier. The magnetic brush thus formed on the developing roller 3 faces a latent image formed on the photoconductor 6, so that the toner in the developer of the magnetic brush is attracted to the photoconductor 6, thereby developing the latent image into a colored image. In this way, the toner is consumed in the image forming process, thereby decreasing the density of toner in the developer. Thereafter, the developer with reduced toner density is fed back to the stirring member 5 by means of the stirring member 4. When the density of toner becomes lower than a predetermined reference value, toner is supplied from the toner hopper 2 onto the stirring member 5 in the developer tank 1. The toner thus supplied is stirred with the developer having reduced toner density by means of the stirring member 5.

The developer tank 1 is also provided with a density sensor 8 on the side opposite from the side having the opening 12, i.e., the density sensor 8 is located beside the stirring member 5. With this arrangement, since the developing roller 3, the stirring members 4 and 5, and the density sensor 8 are arranged in that order substantially in a horizontal plane, so that the height of the developer tank 1 can be kept small. The density sensor 8 measures magnetic permeability of the developer, and the density of toner in the developer is determined based on the measured value of the magnetic permeability.

In a method of determining toner density according to the present invention, the density of toner in the developer is repeatedly measured at regular intervals of time. This process, which is hereinafter referred to as a "density-sampling process", is performed for a predetermined period of time, resulting in sampled data, i.e., a plurality of measured values of toner density. The predetermined period of time for a single density-sampling process is set to be a period of time required for the stirring member 5 to substantially make an integral number of complete revolutions, i.e., one complete revolution or a plurality of complete revolutions. After the density sampling process is completed, the measured values of toner density are averaged, so that the mean value is taken as the density of toner in the developer. In this procedure, the density of toner in the developer can be accurately determined even by the use of the density sensor 8 located in the area near the stirring member 5, where the toner density greatly fluctuates with the rotation of the stirring member 5. This will be described in more detail below.

Figure 2:
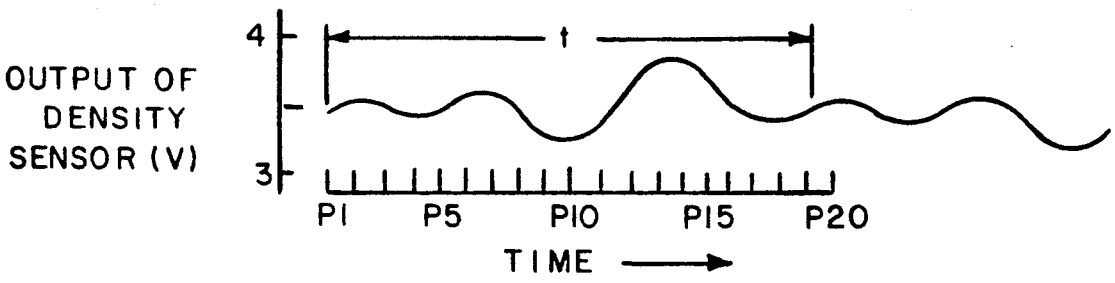
FIG. 2 is a graph showing the output of a density sensor with respect to the elapsed time.
Figure 3:
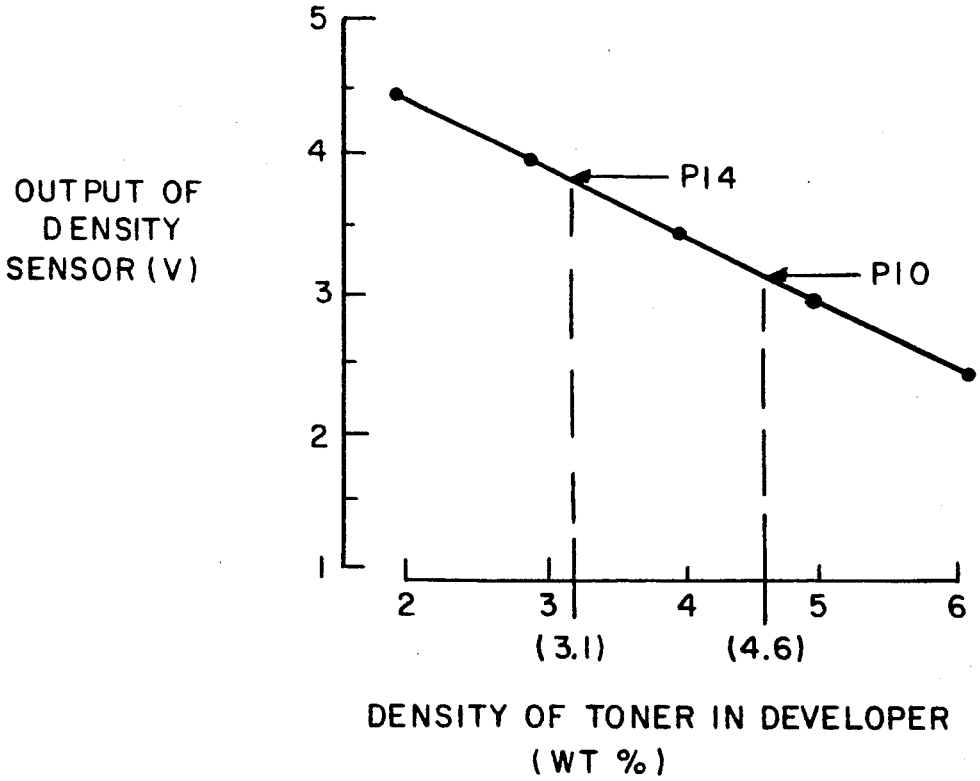
FIG. 3 is a graph showing the relationship between the output of the density sensor and the values of toner density determined on the basis of the output.

FIG. 2 shows the output of the density sensor 8, which is represented by voltages, in the case where the density sensor 8 located in the vicinity of the stirring member 5 repeatedly measures the magnetic permeability of the developer at regular intervals of time while the stirring member 5 is rotating. FIG. 3 shows the relationship between the output of the density sensor 8 and the values of toner density determined on the basis of the output. The "t" shown in FIG. 2 represents the time required for the stirring member 5 to make one complete revolution. As shown in FIG. 2, the output of the density sensor 8 greatly fluctuates while the stirring member 5 makes one complete revolution. Referring to FIGS. 2 and 3, during the complete revolution of the stirring member 5, the values of toner density determined by the output range from approximately 2.5 to 5% by weight, based on the weight of the developer Furthermore at the time when a single revolution of the stirring member 5 is completed, the density of toner comes back to substantially the same level as that obtained at the beginning of the revolution. This means that the density of toner in the area near the stirring member 5 fluctuates in synchronization with the revolution of the stirring member 5. Thus, in order to obtain an accurate value of toner density, the measured values of toner density should be averaged over a period of time required for the stirring member 5 to make one complete revolution or a plurality of complete revolutions. Therefore, as described above, in a method of determining the density of toner according to the invention, the density sampling process is performed for a period of time required for the stirring member 5 to substantially make an integral number of complete revolutions, and thereafter the measured values of toner density are averaged so that the mean value obtained is taken as the density of toner in the developer.

Figure 1:
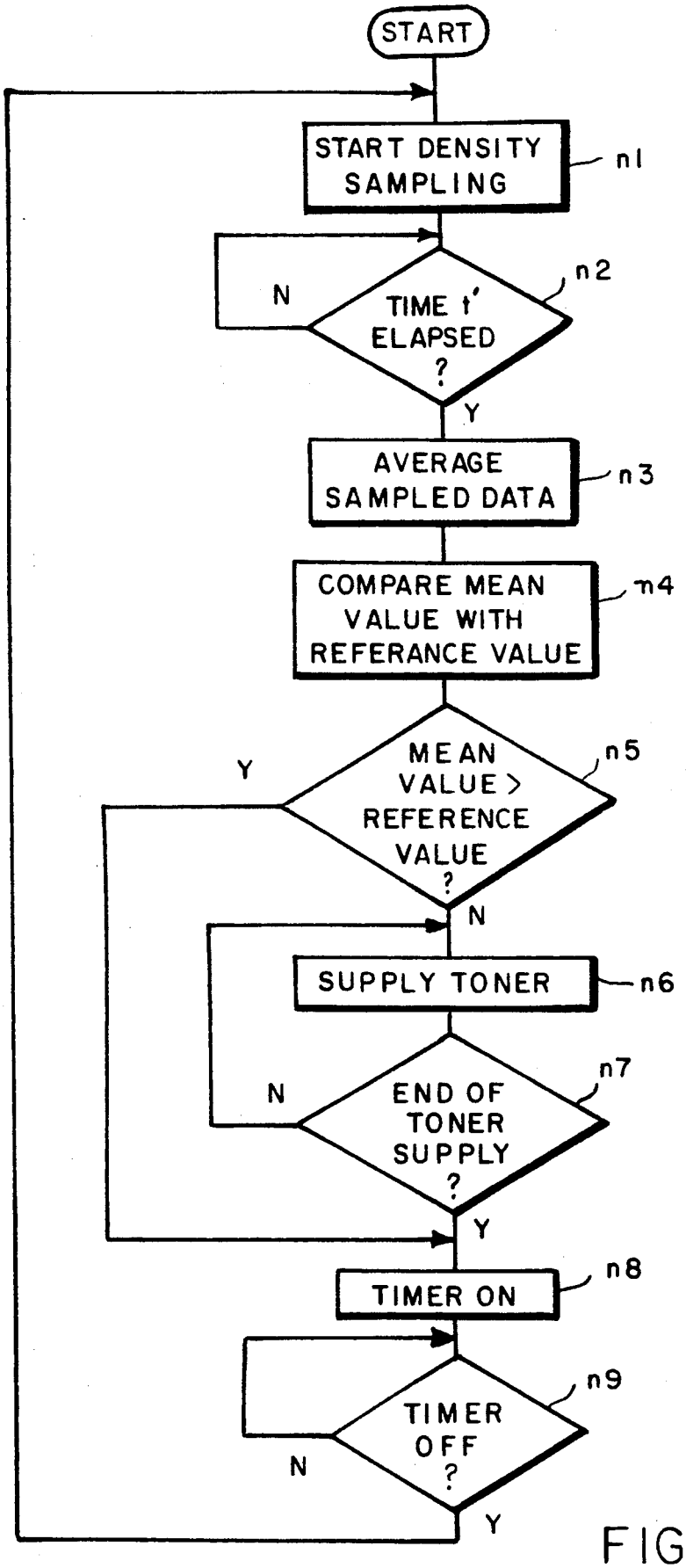
FIG. 1 is a flowchart showing a procedure for determining the density of toner in developer in accordance with the invention.

FIG. 1 shows a procedure for determining the density of toner in the developer by the use of a method according to the present invention. In steps n1 and n2, a density sampling process is performed for a predetermined period of time t', which is the time required for the stirring member 5 to substantially make one complete revolution or a plurality of complete revolutions. Through the density sampling process, sampled data, i.e., a plurality of measured values of toner density, can be obtained. Thereafter, the mean value of these measured values is then calculated in step n3. In steps n4 and n5, the mean value thus obtained is compared with a predetermined reference value of toner density. If the mean value is equal to or lower than the reference value, the toner feed roller 9 is made to rotate for a prescribed duration of time to supply toner to the developer tank 1 in step n6 If the mean value is higher than the reference value in step n5, or when supply of the toner is completed (step n7), a timer is turned on in step n8 so as to measure a prescribed period of time. When the timer is turned off in step n9, the procedure goes back to step n1 so that the next density sampling process begins. Because the toner density does not drop abruptly and also because there arises extreme unevenness in the toner density immediately after supply of the toner, this prescribed period of time in steps n8 and n2 is necessary before starting the next density sampling process.

As described above, in a method according to the invention, since the density sensor 8 is mounted beside the stirring member 5, the developing roller 3, the stirring members 4 and 5, and the density sensor 8 are arranged substantially in a horizontal plane, so that the height of the developer tank 1 can be kept small. Furthermore, in this method, the values of toner density measured by the density sensor 8 are averaged over a period of time required for the stirring member 5 to substantially make an integral number of complete revolutions. Thus, the unevenness in the toner density caused by the revolution of the stirring member 5 can be leveled off, so that the density of toner in the developer can be accurately determined.

It is understood that various other modifications will be apparent to and can be readily made by those skilled in the art without departing from the scope and spirit of this invention Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method of determining the density of toner in a developer stored in a developer tank, the toner being mixed by a stirring member and a developing roller disposed mutually on the same level in the developer tank, said method comprising the steps of:

measuring the density of toner in the developer at regular intervals of time by a density sensor disposed on the same level with and in the vicinity of the stirring member for a predetermined period of time, the density sensor being located in the vicinity of the stirring member, and the predetermined period of time being the time required for the stirring member to make an integral number of complete revolutions; and averaging the values of toner density measured by the density sensor.

2. A method of determining the density of toner in developer used in a developing unit which has a developer tank containing the developer and also has a stirring member and a developing roller both disposed in the developer tank, said method comprising the steps of:

repeatedly measuring the density of toner in the developer at regular intervals of time by the use of a density sensor for a predetermined period of time, the density sensor being located in the vicinity of the stirring member, and the predetermined period of time being the time required for the stirring member to make an integral number of complete revolutions; and averaging the values of toner density measured by the density sensor.

3. A method according to claim 2, wherein the measuring of the density of toner is performed by measuring magnetic permeability of the developer.

* * * * *